US006382756B1

(12) United States Patent
Komuro

(10) Patent No.: US 6,382,756 B1
(45) **Date of Patent: *May 7, 2002**

(54) RECORDING HEAD AND RECORDING METHOD

(75) Inventor: Hirokazu Komuro, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/902,947

(22) Filed: Jul. 30, 1997

(30) Foreign Application Priority Data

Jul. 31, 1996 (JP) ..... 8-202077

(51) Int. Cl.[7] ..... B41J 29/38; B41J 29/393; B41J 2/05

(52) U.S. Cl. ..... 347/14; 347/19; 347/57

(58) Field of Search ..... 347/14, 19, 17, 347/50, 59, 57; 324/765

(56) References Cited

U.S. PATENT DOCUMENTS

| | | | | |
|---|---|---|---|---|
| 4,750,010 A | * | 6/1988 | Ayers et al. | 347/237 |
| 4,860,033 A | | 8/1989 | Shiozaki et al. | 346/140 R |
| 4,881,318 A | | 11/1989 | Komuro et al. | 29/827 |
| 5,253,934 A | * | 10/1993 | Potucek et al. | 347/237 |
| 5,322,811 A | | 6/1994 | Komuro et al. | 437/51 |
| 5,479,197 A | | 12/1995 | Fujikawa et al. | 347/63 |
| 5,485,185 A | | 1/1996 | Sueoka et al. | 347/64 |
| 5,491,505 A | | 2/1996 | Suzuki et al. | 347/203 |
| 5,580,468 A | | 12/1996 | Fujikawa et al. | 216/27 |
| 5,649,359 A | | 7/1997 | Murakami et al. | 29/890.1 |
| 5,654,896 A | * | 8/1997 | Ochi | 364/488 |
| 5,838,341 A | * | 11/1998 | Hiwada | 347/14 |
| 6,042,213 A | * | 3/2000 | Hayasaki | 347/19 |

FOREIGN PATENT DOCUMENTS

| | | |
|---|---|---|
| EP | 0 592 221 | 4/1994 |
| EP | 0641656 | 3/1995 |
| GB | 2 157 108 | 10/1985 |
| GB | 2 285 164 | 6/1995 |
| JP | 54-51837 | 4/1979 |
| JP | 57-72867 | 5/1982 |
| JP | 7-76077 | 3/1995 |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

A recording head for recording data on a recording medium includes a heat generating resistor layer and an electrode layer formed on an element substrate, the heat generating resistor layer and the electrode layer constituting an electrothermal converter for generating heat energy, a driver element built in the element substrate for driving the electrothermal converter and an element built in the element substrate for detecting the characteristics of the driver element.

12 Claims, 5 Drawing Sheets

RECORDING HEAD AND RECORDING METHOD

BACKGROUND OF THE INVENTION

1. Field of the Invention

The present invention relates to a recording head for recording data on a recording medium, a recording apparatus and a recording method. More particularly, the present invention relates to an ink jet recording head for forming a liquid droplet by discharging liquid from an orifice, an ink jet recording apparatus and an ink jet recording method.

2. Related Background Art

Ink jet recording of this type is disclosed, for example, in Japanese Patent Application Laid-Open No. 54-51837. This ink jet recording applies heat energy to liquid to generate a motive force for discharging liquid droplets.

Specifically, according to this ink jet recording described in the above Application, liquid applied with heat energy is heated and bubbles are formed. A force generated by these bubbles impels a liquid droplet to discharge from an orifice formed at the top of a recording head to thereby record data on a recording medium.

A recording head used for this recording method is generally provided with: an orifice (discharge port) from which liquid is discharged; an upper protective layer for protecting a heat generating resistor element from ink, the resistor element being an electrothermal converter functioning as a means for generating heat energy to be used for discharging a liquid droplet; and a liquid discharging unit having a liquid flow path partially constituted of a heat acting part at which the heat energy for discharging a liquid droplet is applied to the liquid.

A driver element for driving such an electrothermal converter is built in the same element substrate as the converter, which is proposed in Japanese Patent Application Laid-Open No. 57-72867.

The driver element built in the element substrate is generally formed by a bipolar transistor or an NMOS transistor. Each of these transistors has some on-resistance. It is said that a variation of on-resistances of NMOS transistors is particularly large.

As described in Japanese Patent Application No. 5-223495, for the correction of energy to be applied to an electrothermal converter to compensate for a variation of each sheet resistance of a heat generating resistor layer constituting the electrothermal converter, a detector for detecting a sheet resistance is formed on an element substrate on which the electrothermal converter is formed. The detected information is picked up from the head to change the conditions, e.g., a pulse width of a signal input to the head from the printer. With this correction, energy applied to the electrothermal converter is made constant.

The amount of energy applied to an electrothermal converter greatly influences the printing performance and durability. The printing performance becomes better as the energy is increased more. From the viewpoint of the printing durability, it is required to lower the energy amount in order to prevent breakage of the electrothermal converter. A liquid droplet smaller than that conventionally used is required to be discharged, as the recording density and precision become higher. The printing performance is therefore required to be considered more than conventional.

In order to improve ecological effects, a cartridge with an integrated head and ink tank is now changing to a separation type of a head and ink tank so that the head can be used during a longer period by replacing only the ink tank. In this connection, the durability of a head becomes more important than conventional.

From the above reason, it is necessary to precisely control the amount of energy to be applied to an electrothermal converter.

However, as described earlier, the drive element for driving an electrothermal converter has some on-resistance which varies depending upon drive element manufacture processes. Even if the same voltage is applied to a head, the voltage applied across electrothermal converters becomes different if on-resistances are different. In this case, the printing performance changes with each head, and heads with bad printing performance may appear. Apart from this, electrothermal converters of some heads may become non-conductive.

NMOS transistors in particular have a large variation of on-resistances although manufacture processes of driver elements are simple and the cost can be reduced. The above problems may possibly occur therefore when NMOS transistors are used for drive elements.

If the drive conditions are properly set in accordance with the measured on-resistance of each head before it is shipped, the above problems can be avoided. However, in the case of a head of the type replaceable by a user, a user is required to set the drive conditions each time the head is changed.

SUMMARY OF THE INVENTION

In order to solve the above problems, a recording head of this invention comprises: a heat generating resistor layer and an electrode layer formed on an element substrate, the heat generating resistor layer and the electrode layer constituting an electrothermal converter for generating heat energy; a driver element built in the element substrate for driving the electrothermal converter; and an element built in the element substrate for detecting the characteristics of the driver element.

The recording head as above may further comprise an ink flow path disposed with the electrothermal converter, the ink flow path including a heat acting unit communicating with an ink discharge port and generating bubbles in liquid by supplying the liquid with heat energy.

A recording apparatus for recording data on a recording medium comprises: the recording head as described above; and means for transporting the recording medium on which data is recorded by the recording head.

A recording method for recording data on a recording medium comprises the steps of: providing a recording head including an electrothermal converter to be used for recording, a driver element for driving the electrothermal converter, and driver element characteristics detecting means for detecting the characteristics of the driver element; detecting the characteristics of the driver element with the driver element characteristics detecting means; and changing the drive conditions of the electrothermal converter in accordance with the detection results of the driver element characteristics detecting means.

DETAILED DESCRIPTION OF THE PREFERRED EMBODIMENTS

Embodiments of the invention will be described with reference to the accompanying drawings.

The term "record" used in the invention means not only the formation of a meaningful image such as characters and graphics on a recording medium but also the formation of a meaningless image such as patterns on a recording medium.

The invention is applicable to apparatuses such as printers, copiers, facsimile apparatuses having communication systems, word processors with printer units, and other recording apparatuses for industrial use formed by a combination of various processing apparatuses, which printers and the like perform recording on the recording media, e.g., paper, string, fiber, cloth, metal, plastic, glass, lumber, ceramics and the like.

The term "element substrate" used in the invention does not mean simply a substrate itself made of silicon semiconductor but means a substrate formed with various elements, wiring and the like.

The term "on an element substrate" used in the invention means not only "over the element substrate" but also "on the surface of the element substrate" and "in a surface layer of the element substrate". The term "built-in" used in the invention does not mean simply mounting separate elements independently on an element substrate but means fabricating elements integrally on an element substrate by semiconductor manufacture processes and the like.

In the following description, an ink jet recording head is used which discharges ink from an ink discharge port under a pressure generated by a film boiling phenomenon of ink in a flow path applied with heat generated by an electrothermal converter. The invention is not, however, limited only to this type of recording heads, but other recording heads may be used if they are of the type that an electrothermal converter and its driver element are integrally fabricated on the same element substrate.

First, the structure of a recording head according to an embodiment of the invention will be described.

Figure 1:
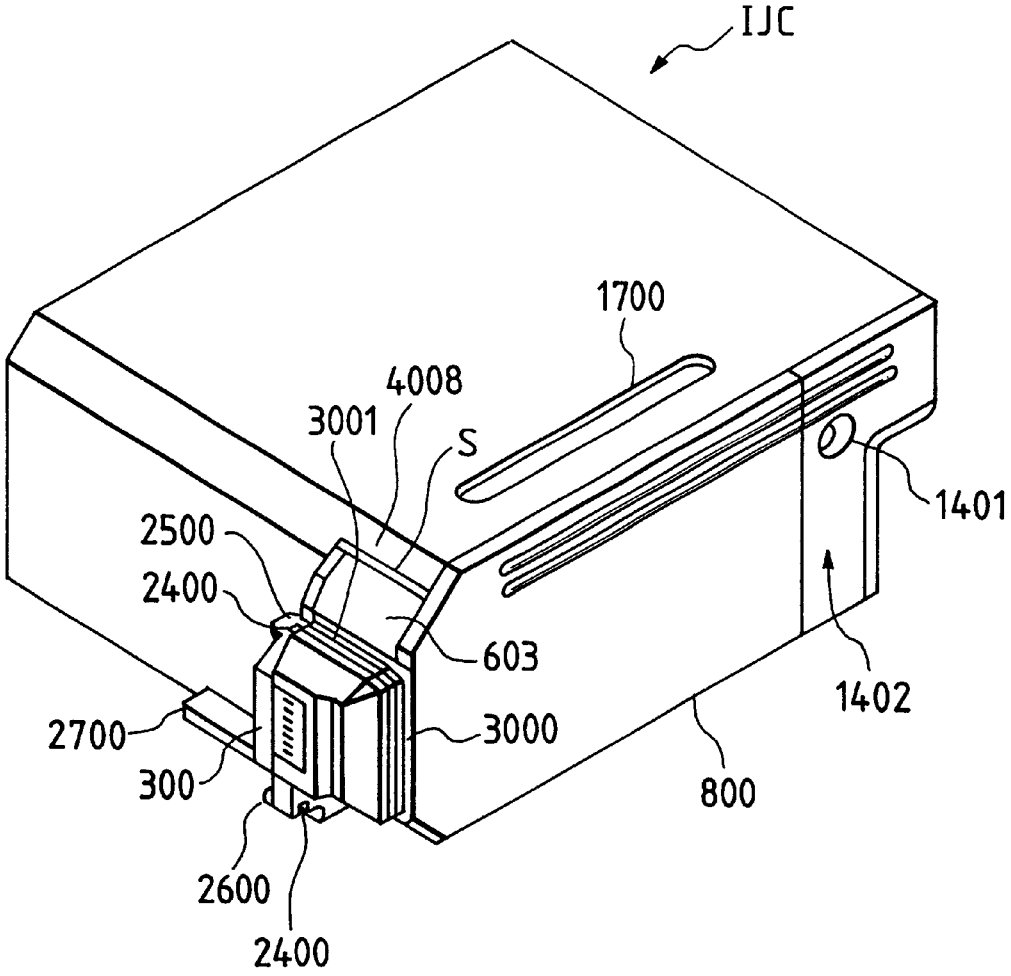
FIG. 1 is a schematic perspective view of a recording head according to an embodiment of the invention.

As seen from the perspective view shown in FIG. 1, an ink jet cartridge IJC of this embodiment is made of an integration of an ink jet head unit and an ink tank so that a large amount of ink can be reserved in the ink tank. This ink jet cartridge IJC is fixedly supported by a carriage positioning means and electrical contacts mounted on an ink jet recording apparatus IJRA (FIG. 6), and is of a disposable type capable of being dismounted from the carriage positioning means.

Figure 2:
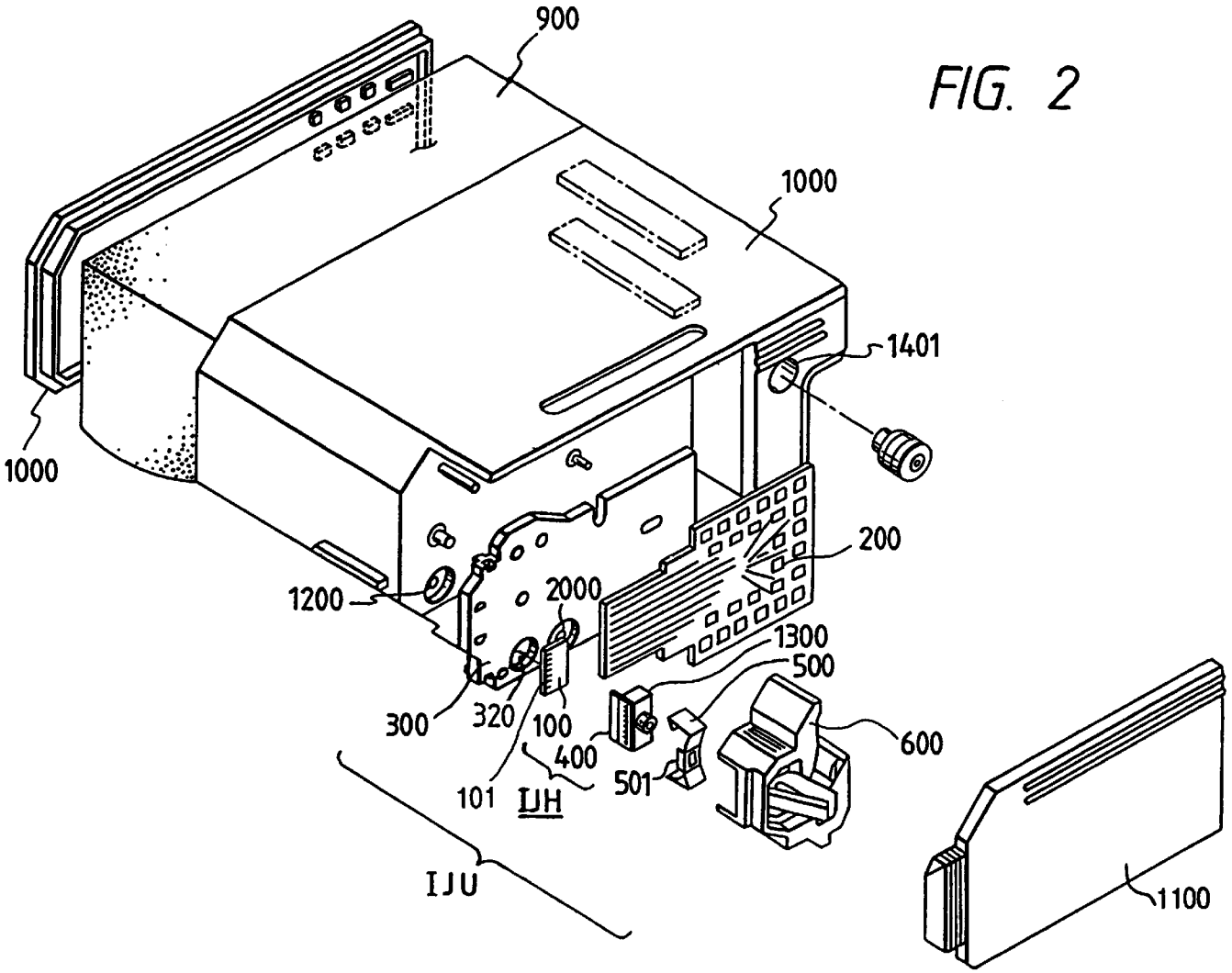
FIG. 2 is an exploded perspective view of the recording head shown in FIG. 1.

As shown in FIG. 2, an ink jet unit IJU is a bubble jet type unit provided with an electrothermal converter 2 which generates heat energy for causing film boiling of ink in response to an applied electrical signal.

In FIG. 2, reference numeral 100 represents a heater board (element substrate) formed (built-in), by film forming technology, with a plurality of electrothermal converters (discharge heaters) disposed in a row on an Si substrate, electrical interconnections made of Al or the like for supplying power to the electrothermal converters, driver elements for selectively driving the electrothermal converters, driver element characteristics detecting means to be described later, and the like. Reference numeral 200 represents a wiring board used with the heater board (element substrate).

Reference numeral 1300 represents a grooved top plate provided with partitions (grooves), a common liquid chamber, and the like. The partitions define each of a plurality of ink paths provided in correspondence with the electrothermal converters. The common liquid chamber reserves ink which is supplied to each ink path. This groove top plate 1300 is integrally molded with an orifice plate 400 having a plurality of ink discharge ports in correspondence with the ink paths. The material of this integrated structure is preferably polysulufone resin, but other molding resin may be used.

Reference numeral 300 represents a support plate made of, for example, metal for supporting the wiring board 200 at the bottom thereof. This support plate 300 serves as a bottom plate of the ink discharge unit. Reference numeral 500 represents a pushing member made of an M-character shaped plate spring whose central area lightly pushes the common liquid chamber. This pushing member 500 has a front skirt portion 501 which pushes linearly part of the flow paths, preferably an area near the ink discharge ports. Feet of the pushing spring member 500 are inserted into holes of the support plate 300 and bent toward the bottom surface of the support plate 300 so that both the heater board 100 and top plate 1300 are squeezed between the pushing member 500 and the front surface of the support plate 300 and stubbornly fixed by a concentrated pressure exerted from the pushing spring member 500 and its front skirt portion 501.

The ink tank is constituted of a cartridge main body 1000, an ink absorbing body 900, and a lid member 1100. The lid member 1100 hermetically seals the ink absorbing body after it is inserted into the cartridge main body from the opposite side to the mount position of the ink jet unit IJU. Reference numeral 1200 represents an ink supply hole for supplying ink to the ink jet unit IJU. Reference numeral 1401 represents an air ventilating port formed in the lid member for communicating the inside of the cartridge with atmospheric air.

In this embodiment, the top plate 1300 is made of resin which is excellent in resistance to ink, such as polysulfone resin, polyether sulfone resin, polyphenylene oxide resin and polypropylene resin. The top plate 1300 is integrally molded with the orifice plate 400 in a mold die.

This integrated mold component of the top plate and orifice plate can be assembled with an ink supply member 600 and the ink tank main body 1000 with high precision. The quality of mass production can also be improved considerably. Furthermore, the number of components can be reduced as compared to a conventional recording head, and excellent performance of the head can be expected.

Next, the features of this invention will further be detailed.

Figure 3:
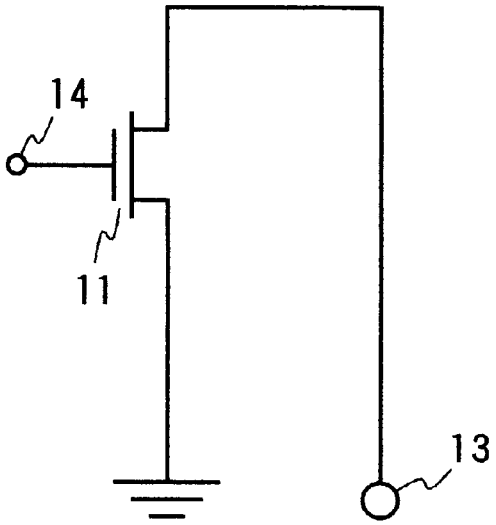
FIG. 3 is an equivalent circuit diagram of an on-resistance measuring element used by an ink jet recording head of this invention.

In order to settle the above-described outstanding issues of this invention, on the same element substrate on which a drive element is formed, a driver element characteristics detecting element is formed as shown in the equivalent circuit of FIG. 3. In accordance with the information detected by this element, the drive conditions of the head are changed. Specifically, the driver element characteristics detecting element, which is manufactured by the same design and same processes as each driver element on the element substrate, is used as an on-resistance measuring element of each head. This on-resistance measuring element is driven by an apparatus provided separately from the head to measure the on-resistance from an applied current and measured voltage. In accordance with this on-resistance, the drive conditions, i.e., a drive pulse width is changed by referring to data preset in a table provided on the apparatus side. In this manner, an energy to be supplied to the electrothermal converter can be maintained constant at each head. If the energy is constant at each head, the constant printing performance of heads can be obtained to improve the printing yield. In addition, circuit breakage in an early stage can be avoided to further improve reliability.

An on-resistance is generally low (up to 10 Ω) so that a measurement precision (S/N ratio) may become insufficient if the on-resistance measuring element is formed by the same design as the driver element of the electrothermal converter. In such a case, an on-resistance measuring element may be formed by different designs in order to improve the measuring precision. In this case, it is necessary not to change a relative amount of on-resistance variations. To this end, if an NMOS transistor is used, the gate length is changed the relative amount.

Figure 4:
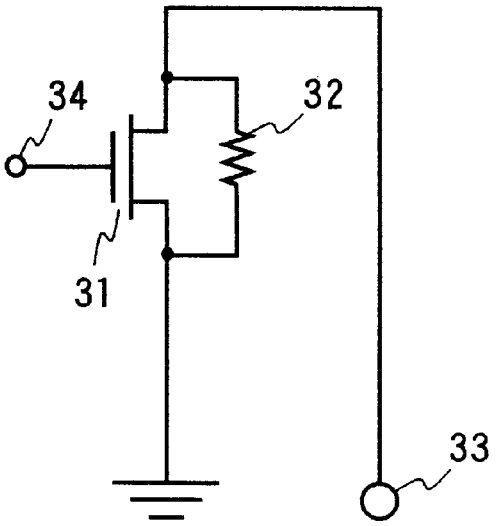
FIG. 4 is an equivalent circuit diagram of an on-resistance measuring element and a sheet resistance measuring element used by an ink jet recording head of this invention.

As described in Japanese Patent Application No. 5-223495, an element for detecting a variation of sheet resistances may be built in the same element substrate on which electrothermal converters as well as on-resistance measuring elements such as shown in FIG. 4 are formed. In this case, although two signal lines for the sheet resistance variation measuring element and on-resistance measuring element are generally required, these two signal lines may be interconnected in the element substrate to incorporate a circuit design allowing only one signal line to be used. Specifically, as shown in FIG. 4, the on-resistance measuring element and sheet resistance variation measuring element are connected in parallel. By turning on and off a signal, e.g., a block select signal to be applied to the on-resistance measuring element, it becomes possible to pick up the on-resistance of the driver element and the sheet resistance of the electrothermal converter from one external terminal.

In this manner, during the on-period, the information (resistance) of both the on-resistance measuring element and sheet resistance variation measuring element can be detected, and during the off-period, the information of only the sheet resistance variation measuring element can be detected. A single external signal line can therefore be used. Accordingly, variation of printing performances of heads can be reduced without raising the cost of heads. As a result, manufacture yield can be improved, circuit breakage of the electrothermal converter in an early stage can be avoided, and reliability can be improved.

In the above manner, by supplying the measurement results of the on-resistance measuring element and sheet resistance variation measuring element for the heat generating resistor element to the external output terminal and to an external apparatus terminal, the drive conditions of the driver element and heat generating resistor element can be changed in accordance with the output information from the external apparatus terminal.

Instead of changing the drive conditions in accordance with the externally supplied variation information of the on-resistance and sheet resistance, the information of these resistances may be processed in the inside of the head because the information is provided in the inside of the head. In this case, the external signal line can be omitted to further improve the reliability and cost. It is easy to fabricate such processing elements and a table by the same processes as driver elements on the same element substrate without raising the cost. Therefore, by forming the on-resistance measuring element and sheet resistance variation element and a device for processing the information of the elements and changing the drive conditions, all in the same element substrate, it becomes possible to reduce the number of signal lines. Therefore, without raising the cost of the printer and head, variation of printing performances can be reduced, manufacture yield can be improved, circuit breakage of the electrothermal converter in an early stage can be avoided, and reliability can be improved.

Next, the structures of each circuit of this invention will be described with reference to the equivalent circuits shown in FIGS. 3 to 6.

FIG. 3 is a circuit diagram of an on-resistance measuring element of an ink jet recording head according to a first embodiment of the invention.

Driver elements for driving electrothermal converters are formed on a silicon substrate by MOS processes. In this case, an on-resistance measuring element 11 having the circuit shown in FIG. 3 is formed by the same MOS processes used for electrothermal converters. Next, electrothermal converters and their power supply electrodes are formed. The size of each electrothermal converter is 50×50 μm. A heat generating resistor layer constituting the electrothermal converter has a sheet resistance of 40 Ω/□ and a resistance of the electrothermal converter was 40 Ω. The total resistance of the electrodes was 2 Ω. Next, a grooved plate formed with nozzles and ink discharge ports is adhered to the element substrate to complete the head.

A resistance is measured by turning on the on-resistance measuring element by supplying an on-signal to an input terminal 14 and picking up information from an external output terminal 13.

TABLE 1

Measurement Results of first Embodiment

| Head | A | B | C |
|---|---|---|---|
| On-resistance (Ω) | 3.0 | 8.0 | 6.0 |
| Total resistance (Ω) | 45.0 | 50.0 | 48.0 |
| Current (mA) | 222 | 200 | 208 |
| Pulse Width (μsec) | 5.3 | 6.5 | 6.0 |
| Heater energy (μJ) | 10.5 | 10.4 | 10.4 |

(Drive voltage = 10 V)

Table 1 shows values of the three heads detected with the on-resistance measuring element 11, drive conditions or pulse widths changed in accordance with the detected values, and energies applied to heaters by the changed pulse widths. A drive voltage used was 10 V. As seen from Table 1, by changing the pulse widths in accordance with the values detected with the on-resistance measuring element 11, energies applied to the heaters can be made constant. In this manner, by forming the on-resistance measuring element on each head and changing the drive conditions of each head, energies applied to the heaters can be made constant. Accordingly, variation of printing performances can be reduced, manufacture yield can be improved, breakdown of the electrothermal converter in an early stage can be avoided, and reliability can be improved.

Next, a second embodiment will be described.

The manufacture method of the element substrate and the size and resistance of the electrothermal converter and electrodes are the same as the first embodiment. The circuit diagram of the on-resistance measuring element is the same as FIG. 3 so that it is omitted. A different point from the first embodiment is that the resistance of the on-resistance measuring element 11 is set 30 times that of the first embodiment in order to improve a measurement precision (S/N ratio). In order not to change a relative amount of on-resistance variations, the on-resistance measuring element is formed to have the same structure as the driver element. A different point is that the gate length of the on-resistance measuring element is set 1/30 that of the driver element. With this arrangement, a value detected with the on-resistance measuring element becomes 30 times that of the on-resistance of the driver element so that the measurement precision (S/N ratio) can be improved.

Similar to the first embodiment, a resistance is measured by turning on the on-resistance measuring element by supplying an on-signal to an input terminal 14 and picking up information from an external output terminal 13.

TABLE 2

Measurement Results of second Embodiment

| Head | A | B | C |
|---|---|---|---|
| Measured on-resistance (Ω) | 90 | 240 | 180 |
| Converted on-resistance (Ω) | 3.0 | 8.0 | 6.0 |
| Total resistance (Ω) | 45.0 | 50.0 | 48.0 |
| Current (mA) | 222 | 200 | 208 |
| Pulse Width (μsec) | 5.3 | 6.5 | 6.0 |
| Heater energy (μJ) | 10.5 | 10.4 | 10.4 |

(Drive voltage = 10 V)

Table 2 shows values of the three heads detected with the on-resistance measuring element 11, converted on-resistance values, drive conditions or pulse widths changed in accordance with the converted values, and energies applied to heaters by the changed pulse widths. A drive voltage used was 10 V. As seen from Table 2, by changing the pulse widths in accordance with the values detected with the on-resistance measuring element 11, energies applied to the heaters can be made constant. In this manner, by forming the on-resistance measuring element on each head and changing the drive conditions of each head, energies applied to the heaters can be made constant. Accordingly, variation of printing performances can be reduced, manufacture yield can be improved, breakdown of the electrothermal converter in an early stage can be avoided, and reliability can be improved.

Next, a third embodiment will be described.

FIG. 4 is a circuit diagram showing an on-resistance measuring element 31 and a sheet resistance measuring element 32.

The manufacture method of the element substrate and the size and resistance of the electrothermal converter and electrodes are the same as the first embodiment. The on-resistance measuring element 31 is the same as the second embodiment. A vertical/horizontal ratio of the sheet resistance measuring element is set 4:1 which is four times that of the electrothermal converter. A large size of 400×100 μm was used for reducing the influence of variation of pattern sizes.

As shown in FIG. 4, the on-resistance measuring element 31 and sheet resistance measuring element 32 are connected in parallel. As an on-signal applied to an internal terminal 34 of the on-resistance measuring element 31, a block select signal for selecting an electrothermal converter block No. 2 was used.

With the above circuit interconnection, when the on-signal is applied to the internal terminal 34, i.e., when the block No. 2 is selected, the parallel resistance of both the on-resistance measuring element 31 and sheet resistance measuring element 32 is measured via an external output terminal 33, whereas when a block other than the block No. 2 is selected, the resistance of only the sheet resistance measuring element 32 is measured via the terminal 33. From these two resistance values, the on-resistance and sheet resistance can be calculated.

TABLE 3

Measurement Results of third Embodiment

| Head | A | B | C | D |
|---|---|---|---|---|
| Measured on-resistance (Ω) with off element 31 | 160 | 140 | 200 | 180 |
| Measured on-resistance (Ω) with on element 31 | 84.7 | 78.8 | 94.7 | 102.9 |
| Converted on-resistance (Ω) | 6.0 | 6.0 | 6.0 | 8.0 |
| Sheet resistance (Ω) | 40 | 35 | 50 | 45 |
| Total resistance (Ω) | 48 | 43 | 58 | 55 |
| Current (mA) | 208 | 233 | 172 | 182 |
| Pulse Width (μsec) | 6.0 | 5.5 | 7.0 | 7.0 |
| Heater energy (μJ) | 10.4 | 10.4 | 10.4 | 10.4 |

(Drive voltage = 10 V)

Table 3 shows values or sheet resistance values of the four heads detected with the on-resistance measuring element 31 when the element is turned off, i.e., when the block other than the block No. 2 is selected by applying an off-signal to the internal terminal 34, values detected with the on-resistant measuring element 31 when the element is turned on, i.e., when the block No. 2 is selected by applying the on-signal to the internal terminal 34, converted on-resistance values, drive conditions or pulse widths changed in accordance with the converted values, and energies applied to heaters by the changed pulse widths. A drive voltage used was 10 V. As seen from Table 3, by changing the pulse widths in accordance with the values detected with the on-resistance measuring element 31 and the sheet resistance values measured with the sheet-resistance measuring element 32, energies applied to the heaters can be made constant. In this manner, by forming the on-resistance measuring element and sheet resistance measuring element on each head, interconnecting both the elements, and changing the drive conditions of each head in accordance with the measured values, energies applied to the heaters can be made constant. Accordingly, variation of printing performances can be reduced, manufacture yield can be improved, breakdown of the electrothermal converter in an early stage can be avoided, and reliability can be improved. Further, since the number of signal lines does not increase, the cost of head and printers can be suppressed from increasing.

Next, a fourth embodiment will be described.

Figure 5:
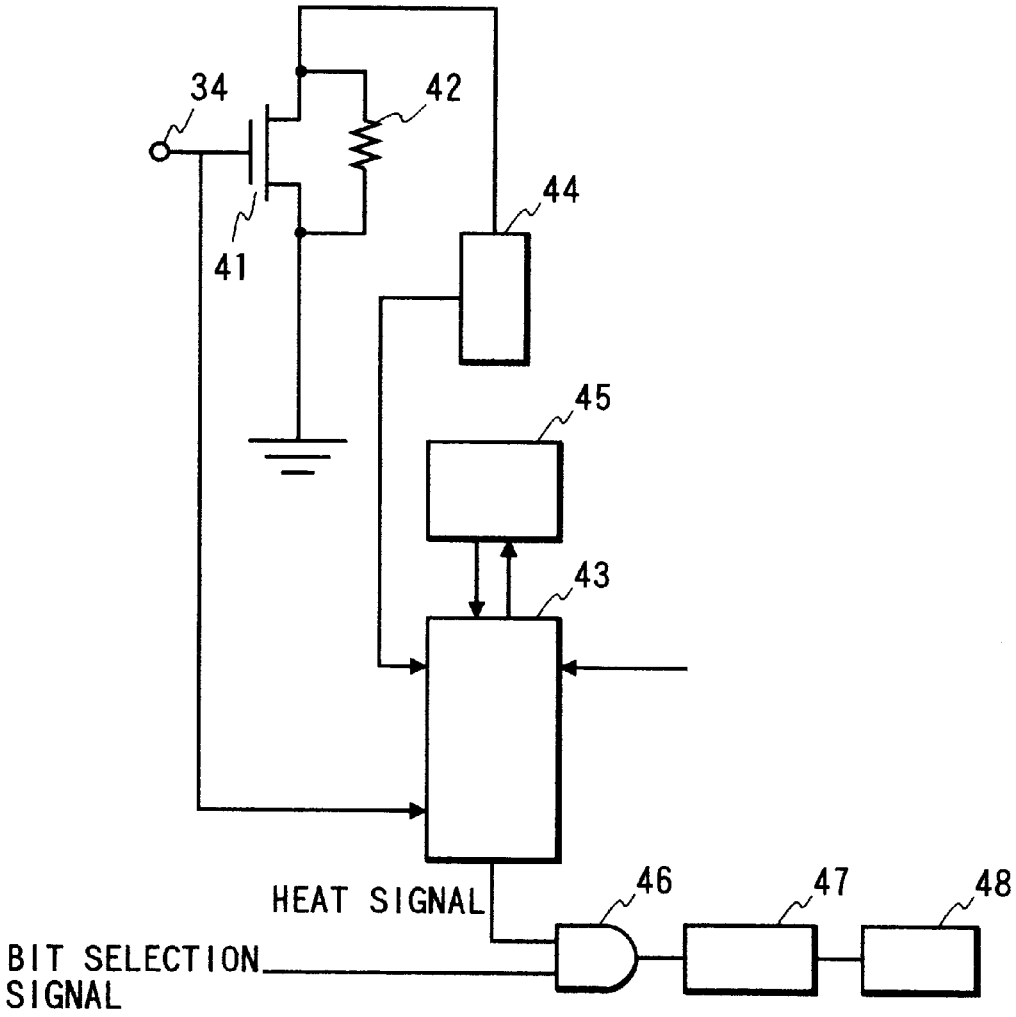
FIG. 5 is an equivalent circuit diagram of an on-resistance measuring element, a sheet resistance measuring element, and other necessary circuits used by an ink jet recording head of this invention.

FIG. 5 is a circuit diagram showing an on-resistance measuring element 41, a sheet resistance measuring element 42, and a processing circuit 43 according to the fourth embodiment.

The manufacture method of the element substrate and the size and resistance of the electrothermal converter and electrodes are the same as the first embodiment. The on-resistance measuring element 41 is the same as the second embodiment. The sheet resistance measuring element 42 is the same as the third embodiment.

As shown in FIG. 5, the on-resistance measuring element 41 and sheet resistance measuring element 42 are connected in parallel. As an on-signal applied to an internal terminal 34 of the on-resistance measuring element 41, a block select signal for selecting an electrothermal converter block No. 2 was used.

This on-signal line is also connected to the processing circuit 43. A parallel connection of the on-resistance measuring element 41 and sheet resistance measuring element 42 is connected to a resistance measuring circuit 44 an output of which is supplied to the processing circuit 43. In accordance with this output, a heat signal is changed to change the pulse width, by referring to data stored in a table 45 formed on a ROM. An AND of the heat signal and a bit selection signal turns on and off the driver element 47. As above, by forming these circuit elements in an element substrate of the head, it becomes unnecessary to output signals to the outside of the head to thereby improve reliability and cost. Since these circuit elements can be easily formed on the same element substrate at the same time when driver elements are formed, there is no increase in cost. Accordingly, the total reliability and cost of head and printer can be improved.

In the following, an ink jet recording apparatus using the recording head of this invention will be described.

Figure 6:
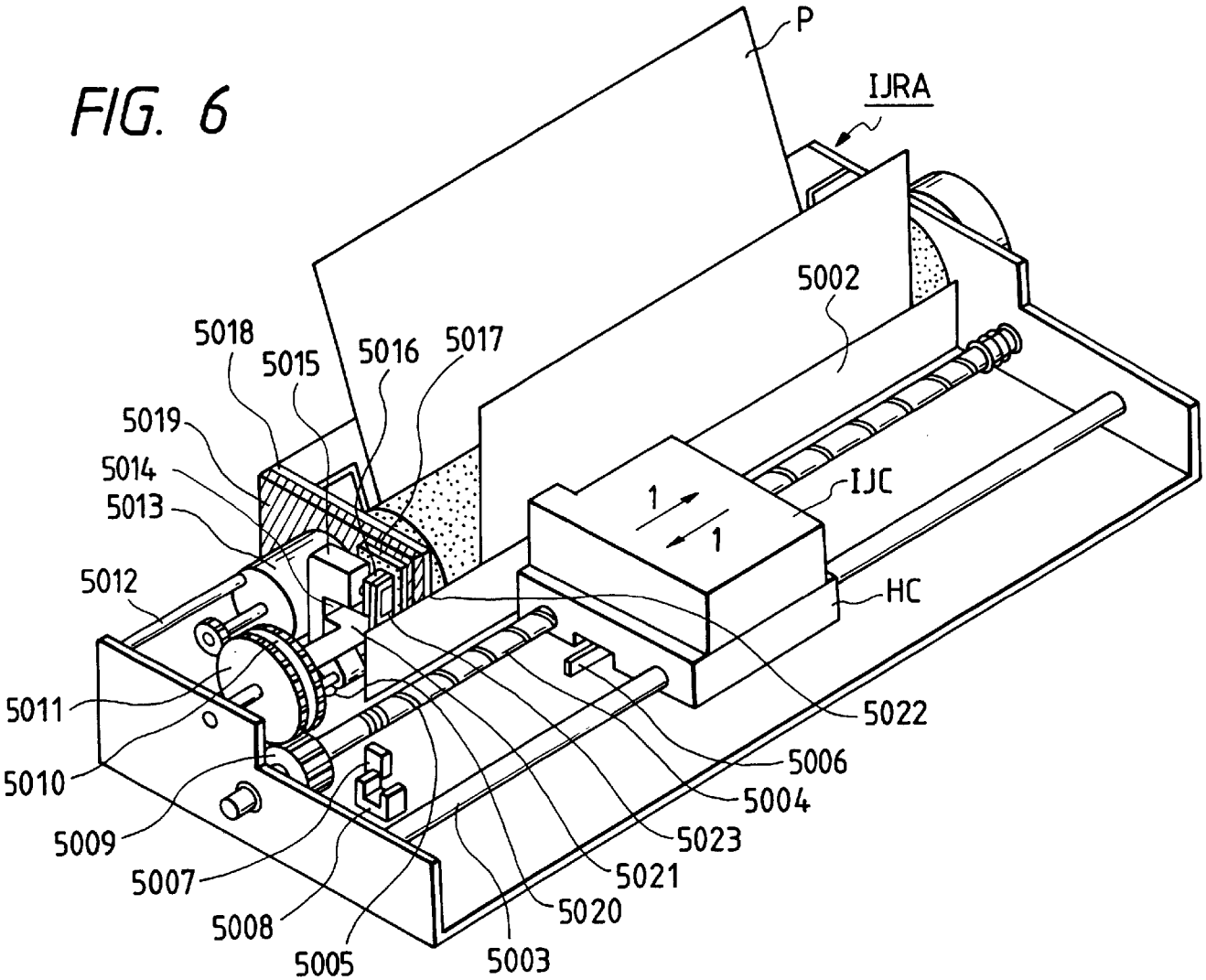
FIG. 6 is a schematic perspective view showing the outline of the structure of a recording apparatus of this invention.

FIG. 6 shows the outline of an ink jet recording apparatus IJRA embodying this invention. A carriage HC with an unrepresented pin reciprocally moves arrow directions a and b. The carriage HC engages with a spiral groove 5004 of a lead screw 5005 which rotates via drive force transmission gears 5011 and 5009 in association with normal and reverse rotations of a drive motor 5013. Reference numeral 5002 represents a paper pusher for pushing a paper sheet against a platen 5000 over the whole transport span of the carriage HC. Reference numerals 5007 and 5008 represent photocouplers which serve as a home position detector for detecting a presence of a lever 5006 of the carriage HC in a monitor area to switch between the rotation directions of the motor 5013 and to perform other necessary operations. Reference numeral 5016 represents a member for supporting a cap member 5022 which caps the front of a recording head. Reference numeral 5015 represents a suction unit for evacuating the inside of the cap to suck or release the recording head via an opening 5023 formed in the cap. Reference numeral 5017 represents a cleaning blade and reference numeral 5019 represents a driving unit for moving back and force the blade, the blade and driving unit being supported by a main support plate 5018. Obviously, instead of this type of the blade, other known cleaning blades may be used. Reference numeral 5012 represents a lever for starting the suction operation, the lever moving with the motion of a cam 5020 and the drive force from the drive motor being controlled by known transmission means such as clutches.

These capping, cleaning, and sucking operations are executed at proper positions with the help of the lead screw 5005 when the carriage enters the home position area. However, these operations may be executed at other timings well known in this field. The above structure singularly or as a whole is an excellent and preferred example for the application of this invention. Obviously this apparatus is provided with drive signal supply means for driving an ink discharging pressure generator or electrothermal converter.

As described so far, according to the invention, the element for detecting the characteristics of the driver element is formed on an element substrate and the drive conditions of the head are changed in accordance with the information detected by the driver element characteristics detecting element. Accordingly, an energy to be supplied to the electrothermal converter can be maintained constant at each head. If the energy is constant at each head, the constant printing performance of heads can be obtained to improve the printing yield. In addition, circuit breakage in an early stage can be avoided to further improve reliability.

Further, the on-resistance measuring element and sheet resistance variation measuring element are connected in parallel, and a signal, e.g., a block select signal to be applied to the on-resistance measuring element, is turned on and off. During the on-period, the information of both the on-resistance measuring element and sheet resistance variation measuring element can be detected, and during the off-period, the information of only the sheet resistance variation measuring element can be detected. With this configuration, a single external signal line can be used. Accordingly, variation of printing performances of heads can be reduced without raising the cost of heads. As a result, manufacture yield can be improved, circuit breakage of the electrothermal converter in an early stage can be avoided, and reliability can be improved.

Furthermore, by forming the on-resistance measuring element and sheet resistance variation element and a device for processing the information of the elements and changing the drive conditions, all in the same element substrate, it becomes possible to reduce the number of signal lines. Therefore, without raising the cost of the printer and head, variation of printing performances can be reduced, manufacture yield can be improved, circuit breakage of the electrothermal converter in an early stage can be avoided, and reliability can be improved.

What is claimed is:

1. A recording head for recording data on a recording medium, comprising:

an electrothermal converter for generating heat energy constituted by a heat generating resistor layer and an electrode layer formed on an element substrate;

a driver element built in the element substrate for driving the electrothermal converter; and a dummy driver element formed in a same manufacturing step as said driver element but which does not drive the electrothermal converter, and which is built in the element substrate for detecting an on-resistance of said driver element.

2. A recording head according to claim 1, wherein the electrothermal converter is provided correspondingly to an ink flow path and ink is discharged from an ink discharge port by driving said electrothermal converter.

3. A recording head according to claim 1, wherein said driver element is made of an NMOS transistor.

4. A recording head according to claim 1, further comprising a sheet resistance measuring element built in the element substrate for measuring a sheet resistance of said heat generating resistor layer.

5. A recording head according to claim 4, wherein said dummy driver element is interconnected on the element substrate to said sheet resistance measuring element.

6. A recording head according to claim 4, further comprising:

means built in the element substrate for processing information supplied from both said dummy driver element and said sheet resistance measuring element; and control means for changing the drive conditions of the electrothermal converter.

7. A recording head according to claim 1, further comprising:

means built in the element substrate for processing information detected using said dummy driver element; and control means for changing the drive conditions of the electrothermal converter.

8. A recording apparatus for recording data on a recording medium comprising:

a recording head which comprises an electrothermal converter for generating heat energy arranged by a heat generating resistor layer and an electrode layer formed on an element substrate, a driver element built in the element substrate for driving the electrothermal converter, and a dummy driver element formed in a same manufacturing step as said driver element but which does not drive said electrothermal converter, and which is built in the element substrate for detecting an on-resistance of said driver element; and means for transporting the recording medium on which data is recorded by the recording head.

9. A recording method for recording data on a recording medium comprising the steps of:

providing a recording head including an electrothermal converter for recording, a driver element for driving the electrothermal converter, and a dummy driver element formed in a same manufacturing step as said driver element but which does not drive the electrothermal converter, and which is built in the element substrate for detecting an on-resistance of the driver element;

detecting the on-resistance of the driver element using said dummy driver element; and changing the drive conditions of the electrothermal converter in accordance with the detection results of said dummy driver element.

10. A recording method according to claim 9, wherein the electrothermal converter operates to discharge ink from an ink discharge port.

11. A recording method for recording data on a recording medium comprising the steps of:

providing a recording head including an electrothermal converter for recording, a driver element for driving the electrothermal converter, and a dummy driver element formed in a same manufacturing step as said driver element but which does not drive the electrothermal converter, and which is built in the element substrate for detecting an on-resistance of the driver element;

detecting the on-resistance of the driver element using said dummy driver element;

changing the drive conditions of the electrothermal converter in accordance with the detection results of said dummy driver element;

providing a sheet resistance measuring element connected in parallel with said dummy driver element in said recording head;

detecting a parallel resistance of said dummy driver element and said sheet resistance measuring element by turning on said dummy driver element; and detecting a resistance of said sheet resistance measuring element by turning off said dummy driver element.

12. A recording apparatus for recording data on a recording medium comprising:

a recording head which comprises an electrothermal converter for generating heat energy constituted by a heat generating resistor layer and an electrode layer formed on an element substrate, a driver element built in the element substrate for driving the electrothermal converter, and a dummy driver element formed in a same manufacturing step as said driver element but which does not drive the electrothermal converter, and which is built in the element substrate for detecting an on-resistance of said driver element, and wherein said electrothermal converter is provided correspondingly to an ink flow path and ink is discharged from an ink discharge port when said electrothermal converter is driven; and means for transporting the recording medium on which data is recorded by the recording head.

* * * * *